US005447466A

United States Patent [19]

Wang et al.

[11] Patent Number: 5,447,466

[45] Date of Patent: Sep. 5, 1995

[54] CHEMICALLY ASSISTED PROCESS FOR THE MACHINING OF CERAMICS

[75] Inventors: Jerry C. Wang, Bloomington, Ind.; Stephen M. Hsu, Germantown, Md.

[73] Assignee: The United States of America as represented by the Secretary of Commerce, Washington, D.C.

[21] Appl. No.: 99,496

[22] Filed: Jul. 30, 1993

[51] Int. Cl.[6] ..... B24B 1/00; B24B 7/30

[52] U.S. Cl. ..... 451/41; 451/488; 451/450

[58] Field of Search ..... 51/267, 322, 356, 281 R; 125/13.01, 11.22; 451/450, 53, 488, 28

[56] References Cited

U.S. PATENT DOCUMENTS

| | | | |
|---|---|---|---|
| 999,941 | 8/1911 | Yale . | |
| 3,129,182 | 4/1964 | McLean | 252/54 |
| 3,282,665 | 11/1966 | Myers . | |
| 3,618,461 | 11/1971 | Parker . | |
| 4,185,968 | 1/1980 | Scherbaum et al. | 51/317 |
| 4,624,237 | 11/1986 | Inoue | 51/356 |
| 4,731,349 | 3/1988 | Lee et al. . | |
| 5,340,370 | 8/1994 | Cadien et al. | 51/308 |

OTHER PUBLICATIONS

H. Vora et al., "Mechanochemical Polishing of Silicon Nitride", Comm. of the Amer. Ceramic Soc., Sep. 1982, pp. C-140 -C-141.

M. Yasunaga et al., "Mechanism and Application of the 'Mechanochemical . . . Using Soft Powder'", Reprinted from The Sci. of Cer. Machining and Surface Finishing II.

D. P. Stinton, "Assessment of the . . . Surface Preparation of Ceramics".

*Primary Examiner*—Bruce M. Kisliuk
*Assistant Examiner*—Derris H. Banks
*Attorney, Agent, or Firm*—Millen, White, Zelano, & Branigan

[57] ABSTRACT

For the machining of ceramic materials, there are employed halogenated hydrocarbon compositions, e.g., $CCl_4$, $CCl_3CF_3$, $CHCl_2CHCl_2$, and $CCl_2{=}CClCCl{=}CCl_2$, to increase the removal rate of the ceramic material. The halogenated hydrocarbon composition is applied to the contact surface of the machine tool, e.g., a diamond-surfaced grinding wheel, and the ceramic and acts as a chemical assistant in machining the ceramic.

16 Claims, 1 Drawing Sheet

CHEMICALLY ASSISTED PROCESS FOR THE MACHINING OF CERAMICS

This invention relates to the use of halogenated hydrocarbons as a chemical assistant in the machining of ceramic parts or materials.

BACKGROUND OF THE INVENTION

The hard and tough properties of ceramic materials would make them a useful material for machined parts in many areas. However, the high cost of machining ceramic materials has prevented their extensive use for parts requiring machining, such as, precision parts, engine parts and bearings. Current technology relies on forming a shape as close as possible to the desired part and then repeatedly grinding and polishing the shape until the desired part is obtained. This method is not of great utility. It is desirable in the industry to have a process for the bulk removal of ceramic material from the formed shapes, i.e., machining, so that parts can be produced from raw stocks of simple shapes, like rods and flats. However, the hardness and brittleness of ceramics has made machining of these materials difficult and costly. Currently, in general, very hard surfaced tools, such as, diamond tools, are required to machine the ceramic materials. These tools are expensive and their rate of consumption is rapid. Increasing the machining force can increase the material removal rate but it is detrimental to the part being machined since the higher force will induce a high rate of fracture and failure in the part. Accordingly, the current practice is to repeatedly remove small amounts of the material to avoid forces which may form residual surface cracks and failures in the ceramic part which renders it unusable.

In addition to this conventional process for machining ceramic materials, other processes have found limited use for special applications. These processes include machining by: ultrasonics, abrasive jet or water jet, ductile grinding, ultra-stiff machinery, electrochemical means to dress the wheel, and lasers. However, only the conventional method using diamond tools has found any commercial significance. A further background discussion is provided in, D. P. Stinton, "Assessment of the State of the Art Machining and Surface Preparation of Ceramics" ORNL Report to DOE ECUT program DE-AC05-84OR21400 (November 1988).

Yasunaga et al., "Mechanism and Application of the Mechanochemical Polishing Method Using Soft Powders", NBS Sp. Pub. 562 (1979), disclose the use of barium carbonate powders for the improved polishing of silicon ceramics. Improved polishing of quartz by $Fe_3O_4$ and MgO has also been disclosed. Also, Vora et al. disclose the use of $Fe_2O_3$ and $Fe_3O_4$ for polishing silicon nitride, "Mechanochemical Polishing of Silicon Nitride", Am. Cer. Soc., P.C140 (September 1982), and the polishing of boron carbide by NiO or $SiO_2$, "A Study of Mechano-Chemical Machining of Ceramics and the Effect on Thin Film Behavior", Off. of Naval Res., No. N00014-80-C-0437-2 (1983). The polishing of silicon carbide with $SrCO_3$ is also known. All of these teachings suggest the easy removal of a thin film, usually less than 100 Angstroms thick, without directly abrading the surface upon which it is formed. These processes result in a reduction in surface damage but in no significant increase in the machining rate. None of the processes provided an improved machining rate over the conventional diamond tool cutting methods.

It is further known in the art that compositions containing halogenated hydrocarbons are useful as cutting fluids or polishing fluids for the machining or polishing of metals. U.S. Pat. No. 999,941, U.S. Pat. No. 3,282,665, and U.S. Pat. No. 3,618,461.

Finally, it is also known from U.S. Pat. No. 4,731,349, that ceramics, such as alumina, may be ball milled in a suspension of a liquid, such as carbon tetrachloride, which is taught to be inert to the ceramic.

SUMMARY OF THE INVENTION

An object of this invention is to provide an improved method for the use of conventional ceramic machine tools which improves the removal rate of the ceramic materials without significantly damaging the surface of these materials and without the use of such high forces which would cause fracture or failure of the machined part.

Upon further study of the specification and appended claims, further objects and advantages of this invention will become apparent to those skilled in the art.

The inventors have discovered that halogenated hydrocarbons can be used as assistants in conventional machining processes to improve the material removal rate from ceramics, particularly silicon-containing ceramics, at reduced stress levels. It has also been discovered that the assistants produce a very fine surface finish on the machined ceramics. Accordingly, the invention encompasses methods for the machining of ceramics, particularly silicon-containing ceramics, more particularly silicon nitride and/or silicon dioxide-containing ceramics, involving the application of certain halogenated hydrocarbon chemical assistants to the machining surface.

Another object of this invention is to provide compositions of certain chemical assistants which are useful in the above method.

A further objective of this invention is to provide apparatus which are useful in carrying out the above method.

DETAILED DESCRIPTION OF THE INVENTION

The invention provides an improved method for machining ceramics which have high hardness and brittleness properties. By the application of halogenated hydrocarbon compositions to the contact surface of a machine tool and the ceramic to be machined, the rate of removal of the ceramic can be greatly increased, while the force required to achieve the removal is decreased. Also, application of the invention results in machined ceramics whose finished surfaces have a good polish quality with minimal damage. The invention greatly improves the efficiency and utility of producing ceramic parts by machining. Particularly, the invention is useful for preparing ceramic parts requiring precise specifications, for example, engine parts, ball bearings, gears and seals.

The improvement in removal rate eliminates the inefficiencies of the previously used methods requiring several repeated machinings and subsequent polishing of the ceramic parts. In many applications, ceramic parts machined according to the invention will not require extra machining or polishing. Further, the invention results in reduced wear upon the machine tools used to effect the machining. These tools, particularly diamond surface tools, are very expensive and extending their life is an excellent advantage.

An important aspect of the invention lies in the application of halogenated hydrocarbon compositions to the contact surface between the cutting surface of the machine tool and the ceramic material to be machined. The inventors have discovered that halogenated hydrocarbons chemically react with the ceramic materials in a way which allows the materials to be removed with less force and which leaves the machined ceramic surface with a polished finish.

Halogenated hydrocarbons which have been found to be particularly useful are hydrocarbons having 1–10 carbons on the main chain and two or more Cl and/or F substituents. Examples include but are not limited to $CCl_4$, $CCl_3CF_3$, $CHCl_2CHCl_2$, and $CCl_2{=}CClCCl{=}CCl_2$. Particularly preferred is $CCl_4$. Mixtures of the halogenated hydrocarbons can also be used, for example $CH_2Cl_2CHCl_2$ in $CCl_4$.

These compounds are preferably used "neat" i.e., in virtually pure form, or in high concentration in solutions with, for example, water, oil-in-water emulsions, oils or organic solvents. When used in solutions, the halogenated hydrocarbons should be present in an amount of at least 25% by weight, preferably at least 50% by weight. They may also be used in lower concentrations in other fluids used as assistants in machining of ceramic materials.

The inventors have further discovered that the addition of HF, an etching agent, to the halogenated hydrocarbon chemical assistants improves the surface finish of the machined ceramic material. It also further improves the material removal rate. Other etching agents, such as strong acids or alkali solutions, which improve the surface finish of the machined material can also be used in connection with the halogenated hydrocarbon assistants. Examples of such other etching agents are HCl, $H_2SO_4$ and NaOH. The etching agent, when used, is preferably used in an amount of at least 0.0036%.

Without being bound by the mechanism of the invention, it is contemplated that the invention makes use of the reaction of the halogenated hydrocarbon with silicon compounds in the ceramics to chemically assist in the removal of the ceramic material in the area being worked upon. The silicon may react with the halogenated hydrocarbon according to the following equation:

$$Si(ceramic) + CX \rightarrow SiX + CO_2,$$

wherein X is a halogen atom. SiX can be removed in the form of a gas, liquid or soft solid. It is believed that the reaction damages the ceramic surface to a minimum extent which assists the mechanical removal and allows an overall high removal rate but which does not noticeably damage the surface. Particular silicon compounds which may be present in ceramics are silicon dioxide, silicon nitride and mixtures thereof. Accordingly, the invention is particularly applicable to ceramics containing silicon compounds and particularly to ceramics containing silicon dioxide and/or silicon nitride.

The invention may be used in connection with any conventional machine tools used to machine ceramic materials. Examples of machine tools to which the invention is applicable, include grinding wheels, drills, millers, etc., or any machine tool having an abrasive contact surface for the machining of ceramics. Particularly preferred are machine tools having an abrasive surface containing diamonds or CBN, preferably in a bonding material.

The halogenated hydrocarbon composition is applied to the contact surface between the cutting surface of the machine tool and the ceramic to be machined. It may be applied in any suitable manner, such as, for example, by spraying, drip feeding, injection or coating. It is preferred that the composition is applied to the surface of the machine tool which will be in contact with the ceramic material to be machined. However, the composition can be applied directly to the contact surface during machining or can be applied to the ceramic surface just before machining.

A further embodiment of the manner of applying the halogenated hydrocarbon composition to the contact surface and a further invention of the inventors is a machine tool apparatus wherein the halogenated hydrocarbon composition is incorporated onto the cutting surface such that upon contact with the ceramic the composition is released to aid in the machining of the ceramic. Such an apparatus could be any of the conventional machine tools which contains on its cutting surface a means for delivering a halogenated hydrocarbon composition to the contact surface during machining. Examples of such coatings or carriers are, for example, bonded coatings containing halogenated hydrocarbons.

BRIEF DESCRIPTION OF THE DRAWING

Various other objects, features and attendant advantages of the present invention will be more fully appreciated as the same becomes better understood when considered in conjunction with the accompanying drawing, in which like reference characters designate the same or similar parts throughout the several views, and wherein.

DETAILED DESCRIPTION OF THE DRAWING

Figure 1:
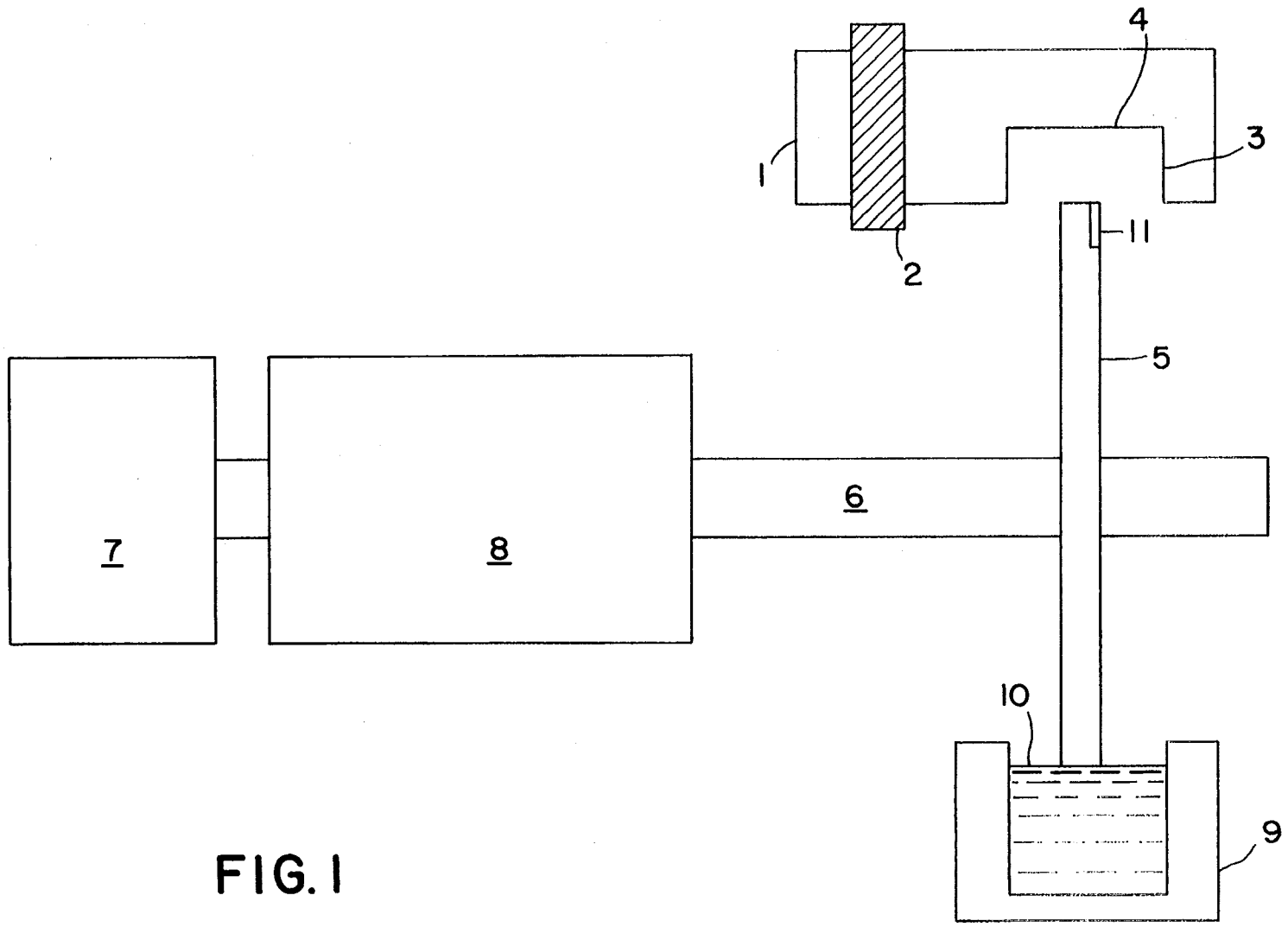
FIG. 1 depicts an embodiment for machining a ceramic material according to the invention.

FIG. 1 depicts an example of one possible system for carrying out the invention. Therein, a ceramic material (1) is held in position by a clamp (2). The material has a cut surface (3) and a ground surface (4) which are to be machined by a grinding wheel (5) having an abrasive cutting surface (11). The grinding wheel is rotated around a shaft (6) driven by a motor (7) and measured by a torque meter (8). The wheel is rotated such that its abrasive cutting surface is brought through a container (9) holding the chemical assistant fluid (10). By this arrangement the chemical assistant is applied to the machine tool cutting surface and is therefore applied to the contact surface between the abrasive cutting surface of the machine tool and the ceramic material where it improves the machining rate and quality.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosures of all applications, patents and publications, cited above and below, are hereby incorporated by reference.

EXAMPLES

A cutting test has been set up to evaluate the performance of different fluids. The configuration is shown in FIG. 1. This test procedure involves a 5" metal-bonded diamond wheel rotating against and cutting either a silicon nitride flat of the dimension 1"×1"×16", or a ¼" diameter rod. The chosen test condition is 5 Newtons (0.5 kg) load, 500 rpm (200 m/min.) speed at room temperature which reasonably simulates a light-duty cutting condition with good repeatability. The silicon nitride used is a material having the designation NC132. NC132 is a commercially available, hot pressed, silicon nitride marketed by Saint Gobain/Norton Industrial Ceramics.

The material removal rate is determined by the time required to cut through a certain depth into the specimen. The flat sample simulates a constant-load, constant-contact area process, and the rod presents cutting of varied contact area, and, therefore, varied contact condition. The torque required for the cutting process is recorded using a torque meter attached to the rotating rod. The surface finish is measured for average surface roughness (Ra) by a profilometer from Talysurf having a capability of measuring surface roughness of less than 0.1 μm. The surface is also observed using a scanning electron microscope (SEM) which will magnify a surface up to over 10,000 times of magnification.

Table 1 shows the effects of using the halogenated hydrocarbon compositions of the invention to cut silicon nitride vs. the use of other commercial fluids. LECO and WBE-55 are two general use cutting fluids, LECO being a naphthenic mineral oil, and WBE-55 being a water-based coolant. PPO is a pure paraffinic mineral oil. These fluids combined with water and a water-oil emulsion represent the most widely used machining fluids in current technology. The method according to the invention results in about 2 to 3 times higher cutting rate, and a smoother surface roughness. Ra is the measured average surface roughness. Usually an Ra of 0.05 μm or less is considered well-polished. Ra of 0.01 is considered to have optical quality.

Table 2 shows the addition of HF to $CCl_4$ and the improvement of surface finish. The Ra improves from 0.09 to 0.07 μm. However, an even more impressive advantage becomes apparent in the SEM microscopic observation of the sample at a power of 1000 times magnification which shows no cracks on the surface that can be discovered. The cutting rate is also increased because the etching agent aids in reducing resistance to the tool and eliminates damage to the surface. This demonstrates the applicability of using an etching agent to modify the surface finish as the machining process proceeds.

Table 3 shows the cutting of a silicon nitride rod of ¼" in diameter. The load of this test has been maintained at 5 Newtons. Because of the change in contact area due to the shape of the workpiece, the contact stress reduces as the cutting proceeds, and resumes higher stresses as the cutting wheel passes through the center of the rod. The cutting rate is high upon the initial contact when commercial fluids have been used. The torque falls to around 10 oz-in indicating that the process has changed from a cutting process to a polishing process due to the reduced contact stress and the high toughness of the material. The cutting virtually stops as the wheel has moved roughly 1/32" into the rod if a paraffin oil is used. The cutting wheel can move 1/16" into the rod before the transition occurs if $CF_3CCl_3$ is used. This indicates the latter fluid remains effective at reduced contact stress. The wheel can cut through the rod in 6 minutes if $CCl_4$ is used. The wheel requires one dressing process when the wheel is over 3/16" into the rod. The dressing process involves engaging a porous silicon carbide rod as if the wheel is cutting this silicon carbide rod, in order to remove clogging debris as well as restoring cutting efficiency. Since the wheel has passed the center, the dressing is to restore the cutting efficiency of the wheel, not to improve it. $CCl_4$ can be used at the lowest contact stress encountered in the center of the rod, which is estimated to be 10 to 100 times less than the initial contact stress.

The improvement in cutting efficiency is apparent. The cutting process lubricated by PPO requires numerous dressings and several hours to cut through the entire ¼". It takes only 1 dressing and 6 minutes to do the same job when neat $CCl_4$ is used.

In all of the examples aforementioned, according to the claimed invention, little or no degradation of the tool, either on the diamond, the metal bond, or other part of the set up, is observable by the unaided eye or by microscope at a power of up to 1000 times magnification. Further, when using the claimed invention, no reduction in the thickness of the bonding material on the grinding wheel, which would indicate unacceptable wear is measured. Also, analysis of residue from the machinings, using the claimed invention, indicates no degradation of the metal grinding wheel or its bonding material coating.

TABLE 1

| Fluids | Torque | Cut Rate, $mm^3$/min | Surface | Ra, μm |
|---|---|---|---|---|
| $CF_3CCl_3$ | 23–37 | 5.4 | 1 | 0.12 |
| $CHCl_2CHCl_2$ | — | 4.2 | 2 | 0.12 |
| $CCl_2{=}CClCCl{=}CCl_2$ | | 4.2 | 2 | 0.10 |
| $CCl_4$ | 23–24 | 4.2 | 1 | 0.09 |
| Water | | 1.98 | 2 | 0.10 |
| Paraffin Oil (PPO) | | 3.6 | 3 | 0.18 |
| LECO | — | 3.6 | 3 | 0.18 |
| WBE-55 | — | 3.0 | 3 | 0.13 |
| 10:90 $H_2O$:PPO + detergent* | 20–25 | 2.4 | 2 | 0.07 |

Surface: density of cracks, 3 the most and 1 the least on a scale of 1 to 3.
*Detergent is Triton X100, an octylphenol polyether from Rohm & Haas Co.

TABLE 2

| Fluids | Ra, μm | Cut Rate $mm^3$/min. |
|---|---|---|
| $CCl_4$ | 0.09 | 4.2 |
| 20 ml of $CCl_4$ + 5 drops of HF | 0.07 | 4.8 |

TABLE 3

| Fluids | Cut Time | Torque initial–final |
|---|---|---|
| PPO | >2 hours | 10–12 |
| $CCl_4$ | 6 minutes | 25–30 |
| $CF_3CCl_3$ | >1 hour | 25–10 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method for machining ceramic materials at a high material removal rate with a machine tool having an abrasive cutting surface which comprises workably engaging the cutting surface of the machine tool to the ceramic material wherein there is caused to be present at at least a part of the contact surface between the abrasive cutting surface of the machine tool and the ceramic material a composition containing at least one halogenated hydrocarbon having 1–10 carbon atoms and two or more F or Cl substituents, thereby increasing the rate of machining.

2. The method of claim 1, wherein the halogenated hydrocarbon is selected from the group consisting of $CCl_4$, $CCl_3CF_3$, $CHCl_2CHCl_2$, $CCl_2{=}CClCCl{=}CCl_2$ and mixtures thereof.

3. The method of claim 1, wherein the ceramic material comprises a silicon ceramic.

4. The method of claim 3, wherein the ceramic material comprises a silicon nitride ceramic, a silicon dioxide ceramic or a mixture thereof.

5. The method of claim 1, wherein the halogenated hydrocarbon composition further contains HF, $H_2SO_4$, HCl or NaOH as an etching agent.

6. The method of claim 1, wherein the halogenated hydrocarbon composition contains $CCl_4$.

7. The method of claim 1, wherein the halogenated hydrocarbon composition consists essentially of $CCl_4$.

8. The method of claim 6, wherein the halogenated hydrocarbon composition further contains HF, as an etching agent.

9. The method of claim 1, wherein the machine tool has a diamond-containing or CBN-containing abrasive cutting surface.

10. The method of claim 9, wherein the machine tool is a grinding wheel.

11. The method of claim 1, wherein the halogenated hydrocarbon composition is applied to the abrasive cutting surface of the machine tool prior to its engaging the ceramic material.

12. The method of claim 1, wherein the halogenated hydrocarbon composition is applied to the contact surface between the abrasive cutting surface of the machine tool and the ceramic material during their workable engagement.

13. The method of claim 1, wherein the halogenated hydrocarbon composition contains 50% by weight or more of halogenated hydrocarbons.

14. The method of claim 1, wherein the halogenated hydrocarbon composition consists of virtually only halogenated hydrocarbons.

15. A composition for improving the removal rate and surface polish quality of ceramic materials during machining which consists essentially of HF and a halogenated hydrocarbon selected from the group consisting of $CCl_4$, $CCl_3CF_3$, $CHCl_2CHCl_2$, $CCl_2{=}CClCCl{=}CCl_2$, and mixtures thereof.

16. The composition of claim 15 wherein the halogenated hydrocarbon is $CCl_4$.

* * * * *